US009856049B2

(12) United States Patent
Seymour

(10) Patent No.: US 9,856,049 B2
(45) Date of Patent: Jan. 2, 2018

(54) PRODUCT PACKAGING HAVING CONDUCTIVE STRIPS FOR ACTIVATING A PRODUCT WITHIN A PACKAGE

(71) Applicant: Arthur Seymour, Wheeling, IL (US)

(72) Inventor: Arthur Seymour, Wheeling, IL (US)

(73) Assignee: ADVINS, INC., Deerfield, IL (US)

( * ) Notice: Subject to any disclaimer, the term of this patent is extended or adjusted under 35 U.S.C. 154(b) by 0 days.

(21) Appl. No.: 15/281,449

(22) Filed: Sep. 30, 2016

(65) Prior Publication Data

US 2017/0103862 A1 Apr. 13, 2017

Related U.S. Application Data

(60) Provisional application No. 62/238,783, filed on Oct. 8, 2015.

(51) Int. Cl.

| | |
|---|---|
| ***H05K 7/00*** | (2006.01) |
| ***B65D 5/42*** | (2006.01) |
| ***B65D 33/00*** | (2006.01) |

(52) U.S. Cl.

CPC ..... *B65D 5/42* (2013.01); *B65D 33/00* (2013.01); *B65D 2201/00* (2013.01)

(58) Field of Classification Search

CPC ..... B65D 5/42; B65D 33/00; B65D 2201/00

USPC ..... 361/837; 340/572.3

See application file for complete search history.

(56) References Cited

U.S. PATENT DOCUMENTS

| | | | | |
|---|---|---|---|---|
| 6,438,685 | B1 * | 8/2002 | Brower | G11B 33/1493 206/308.3 |
| 9,058,733 | B2 * | 6/2015 | Brinkley | G08B 25/016 |
| 2007/0152829 | A1 * | 7/2007 | Lindsay | G06K 19/0717 340/572.3 |
| 2008/0302687 | A1 * | 12/2008 | Sirichai | A45F 5/02 206/320 |

* cited by examiner

*Primary Examiner* — Hung S Bui
(74) *Attorney, Agent, or Firm* — Justin Lampel

(57) ABSTRACT

A first conductive strip connected to a package that interacts with and creates a circuit with a second conductive strip connected to a battery-operated product inside the package is provided. The battery-operated product may be tested while in the package by pressing the first conductive strip against the second conductive strip with an electrical break. The first conductive strip eliminates the electrical break and completes a circuit path with the second conductive strip allowing activation of some or all of the electronic parts of the battery operated product located inside the package. Activation occurs without opening the package allowing it to be returned to shelf for sale in a new condition.

20 Claims, 9 Drawing Sheets

PRODUCT PACKAGING HAVING CONDUCTIVE STRIPS FOR ACTIVATING A PRODUCT WITHIN A PACKAGE

CROSS REFERENCE TO RELATED APPLICATION

The following application is based on and claims the priority benefit of U.S. Provisional Application Ser. No. 62/238,783 filed on Oct. 8, 2015; the entire contents of which are incorporated by reference.

BACKGROUND OF THE INVENTION

A first conductive strip connected to a package that interacts with and creates a circuit with a second conductive strip connected to a battery-operated product inside the package is provided. The battery-operated product may be tested while in the package by pressing the first conductive strip against the second conductive strip with an electrical break. The first conductive strip eliminates the electrical break and completes a circuit path with the second conductive strip allowing activation of some or all of the electronic parts of the battery operated product located inside the package. Activation occurs without opening the package allowing it to be returned to shelf for sale in a new condition. In addition, when the second conductive strip activates the first conductive strip, the components inside the package that may be employed to emit sounds, produce light, or cause motion of other components that can be observed by the person holding the sealed package. Employing multiple conductive strips or tape can activate different components in different areas of the sealed package.

Battery-operated products that may be tested while still in their packages have been sold in the past. These package assemblies typically employ a "Try-Me" feature for the product contained within the package assembly, enabling potential purchasers to try the product before purchasing it. These products generally have lights and/or noise making devices that may be activated to attract the attention to the product while the product is still inside the package. These package assemblies, however, generally use an electronic switch to activate the "Try-Me" feature of the product by utilizing an electronic switch that is not part of the package or packing material. To activate more than one electronic component independently, these products require more than one switch be included inside the package at additional cost to the manufacturer.

For example, U.S. Publication No.: 20130134056 to Nuynak discloses a toy package assembly. The package assembly configures a product and a light source within a blister pack, where the product is illuminated by a light source. The blister pack contains at least one tapered surface that configures the product within the blister pack to maximize the amount of light from the light source that illuminates the product. The product contains a color-changing portion that reacts to the light from the light source by changing color.

Further, U.S. Pat. No. 5,172,806 to Mickelberg discloses an animated toy with articulated moving parts in a package. An opening in the package allows a person to operate a switch to activate the toy. When the toy is activated, the moving articulated parts can be observed through openings in the package or alternatively through transparent sections in the package. In addition, lights can be activated and flashed and an enunciator can be employed to emit light and sounds that are seen and heard by the person while the animated toy is in the package.

Even further, U.S. Pat. No. 5,289,916, also to Mickelberg, discloses an animated toy with articulated moving parts in a package. An opening in the package allows a person to operate a switch to activate the toy. When the toy is activated, the moving articulated parts can be observed through openings in the package or alternatively through transparent sections in the package. In addition, lights can be activated and flashed and an annunciator can be employed to emit light and sounds that are seen and heard by the person while the animated toy is in the package. In another embodiment, the front side of the package is open and the toy is secured to the backside with a band, allowing for access to activate the toy and to observe the moving articulated parts through the open side.

However, these patents and publications fail to disclose a package that allows a user to test a product located within the interior of the package that is easy to use and efficient as in the present device. Therefore, a need exists for a unique package assembly having one or more conductive areas that may independently activate different components of the product while the product is still inside the package. In this manner, potential purchasers can try different components of a product separately or simultaneously without the manufacturer needing to supply numerous expensive electronic switches so that each electronic component may be tested.

SUMMARY OF THE INVENTION

A first conductive strip connected to a package that interacts with and creates a circuit with a second conductive strip connected to a battery-operated product inside the package is provided. The battery-operated product may be tested while in the package by pressing the first conductive strip against the second conductive strip with an electrical break. The first conductive strip eliminates the electrical break and completes a circuit path with the second conductive strip allowing activation of some or all of the electronic parts of the battery operated product located inside the package. Activation occurs without opening the package allowing it to be returned to shelf for sale in a new condition. In addition, when the second conductive strip activates the first conductive strip, the components inside the package that may be employed to emit sounds, produce light, or cause motion of other components that can be observed by the person holding the sealed package. Employing multiple conductive strips or tape can activate different components in different areas of the sealed package.

In one embodiment of the present device, the package may contain a single battery-operated object. In this embodiment, the electronic switch of the object in the package is automatically set in the "on" setting. One contact of a battery is insulated from its contact by a conductive strip assembly that contains at least one electrical break to produce two conductive sections. When a user presses the conductive area of the package down, the conductive area of the package therein removes the electrical break using conductive tape or a conductive strip and therein completes the circuit thus activating the object. Once the object is removed from the package, the object may no longer be activated by the conductive strip assembly or conductive tape on the package; but will automatically activate if the conductive strip assembly with broken electrical connection is removed and the battery contact is restored.

In another embodiment, the package may contain an inserted tray to position an electrical component of the product with respect to the conductive area(s) of the package. The conductive areas of the package assembly may be arranged to act as a simple contact or a complex connection circuit between electronic components such as resistors, light emitting diodes, and even audio reproducing devices. The power source may be located in the inserted product battery holder and may be only connected to the conductive areas of the package when pressure is applied by the user at key locations of the package.

In yet an alternative embodiment of the present device, the package or packaging assembly for an electronic construction toy comprises a number of interlocking building components and a tray that firmly positions these components to predetermined areas of the package. The pressing of the package in the conductive areas therein completes a circuit and therein activates components in the tray of the package. Once the tray is removed from the package, the components may no longer be activated by simply pressing the package as a result of the shorting element remaining within the package.

In still an alternative embodiment, a blister pack or the tray itself may contain a body portion and a "flip-over" portion or an additional cover attached to the body portion. The cover contains conductive portions which perform the circuit completion and which actuate the electronic components in the blister or tray when the user presses these areas. In this embodiment the components may be activated even after the tray is removed from the main package, but not after the components are removed from the tray. Holes in the main package positioned over the conductive areas of the tray would prevent false activation due to package stacking and would require a finger shaped object to apply pressure and complete the circuit through the holes. The components would not function once the tray or blister is removed from the main package and the tray or blister cover is opened or removed.

And in an alternative embodiment, the body of the tray may also contain conductive portions which position components and complete circuit paths from the components to conductive areas under the flip-top of the blister or the conductive areas of the package.

In an alternative embodiment, the body portion of the tray or blister pack comprises positioning that corresponds to or is substantially aligned with openings in the package that allows visual and/or audio affects to be observed by person holding the package.

In still an alternative embodiment, the visual effects of the product may be produced by a light source that may be an LED and the power source enclosed in the product.

Yet, in an alternative embodiment, the LED light source that produces the visual affects may be, for example, two colors wherein each color may be independently activated by pressing on different areas of the package. If this connection requires a reversing of voltage on the LED, it may be performed by using both a conductive area of the package and an inline conductive area of the blister cover.

In an alternative embodiment, the tray or blister may include one or more motors which may connect to other components in the tray or blister and which are activated by pressing on specific areas of the package or tray cover which activate the motors using conductive tape or strips.

Still, in an alternative embodiment, the product inside the package may have both motors and lights that are simultaneously activated by pressing on the conductive area of the strips or tape of the package.

In an alternative embodiment, the tray or blister may include one or more sound producing devices which may connect to other components in the tray or blister and which may be activated by the pressing on specific areas of the conductive strips or tape of the package or tray cover.

In yet another alternative embodiment, the tray or blister may have one or more LEDs, motors, or audio devices which may connect to other components in the tray or blister and which may be activated by the pressing on specific areas of the conductive strips or tape of the package or tray cover.

In an alternative embodiment, the top of the tray or blister pack may be printed and positioned with respect to a light source to produce a lit picture when an area of the package using conductive strips or tape is pressed by the user. The light source may automatically change in color to produce a lit picture with different visual affects.

In an alternative embodiment, the product may contain devices that may be temporarily activated for a short period of time when an area of the package or header of a hanging bag using conductive strips or tape is pressed by the user. These devices may communicate with cellular and other radio frequency devices in close proximity to the package.

For a more complete understanding of the above listed features and advantages of the present product packaging having conductive strips or tape for activating a product within a package reference should be made to the detailed description and the detailed drawings. Further, additional features and advantages of the invention are described in, and will be apparent from, the detailed description of the preferred embodiments.

DETAILED DESCRIPTION OF THE INVENTION

A first conductive strip connected to a package that interacts with and creates a circuit with a second conductive strip connected to a battery-operated product inside the package is provided. The battery-operated product may be tested while in the package by pressing the first conductive strip against the second conductive strip with an electrical break. The first conductive strip eliminates the electrical break and completes a circuit path with the second conductive strip allowing activation of some or all of the electronic parts of the battery operated product located inside the package. Activation occurs without opening the package allowing it to be returned to shelf for sale in a new condition. In addition, when the second conductive strip activates the first conductive strip, the components inside the package that may be employed to emit sounds, produce light, or cause motion of other components that can be observed by the person holding the sealed package. Employing multiple conductive strips or tape can activate different components in different areas of the sealed package.

Figure 1:
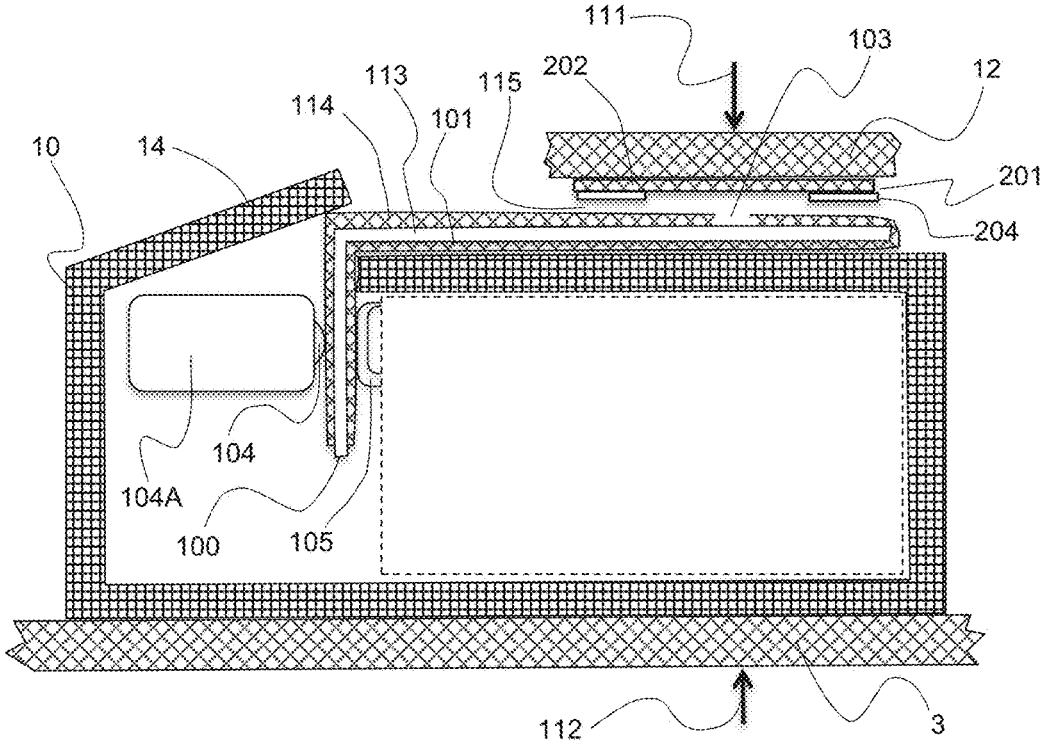
FIG. 1 illustrates a cross-sectional side view of a conductive strip 100 used to activate battery 104A located within a product package.
Figure 12:
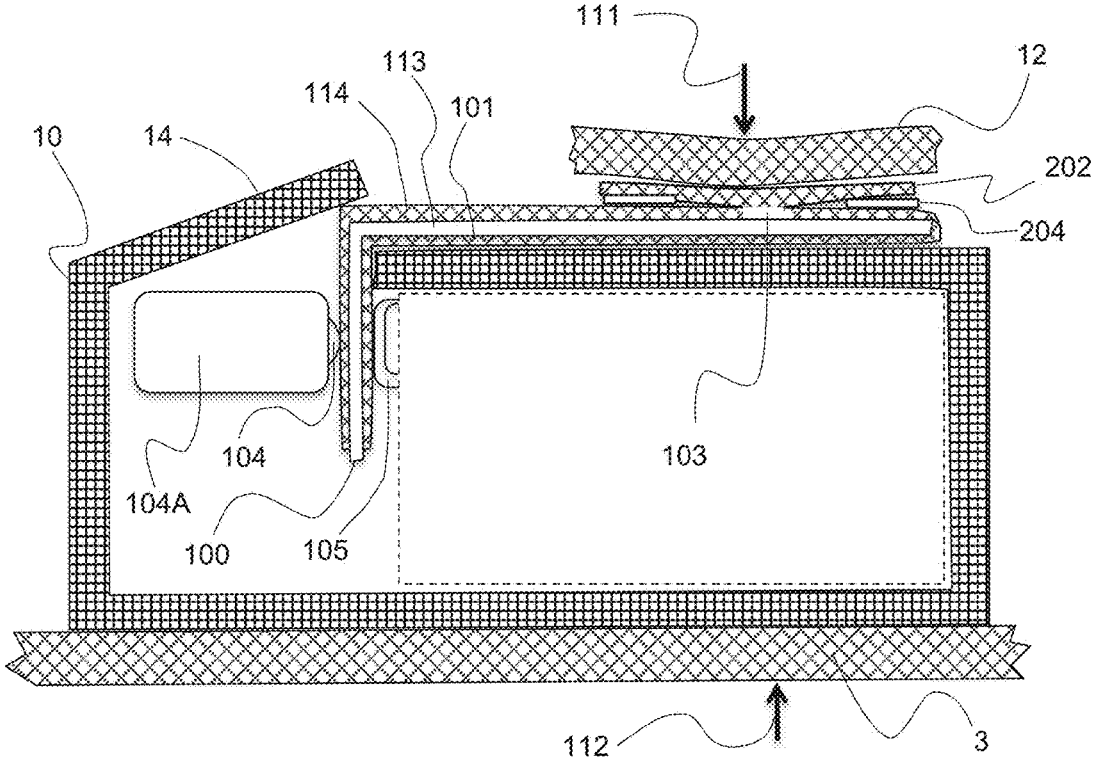
FIG. 12 illustrates the second conductive strip 100 being activated by being contacted by the first conductive strip 202.

A product packaging device having conductive strips for activating a product inside the packaging is provided. More specifically, the product packaging 1 (FIG. 9) may have a first conductive strip assembly 201 connected to a package 1 which interacts with and creates a circuit with a second conductive strip assembly 100, which has a gap 103, (which is a physical gap and an electrical gap) connected to a battery-operated product 10 located inside the package 1. In an embodiment, the first conductive strip assembly 201 may be slightly bendable (or 'flexible'). In an embodiment, the second conductive strip assembly 100 may be bendable. Finally, in an alternative embodiment, the first conductive strip assembly 201 is bendable while the second conductive strip assembly 100 is not bendable. In an embodiment, the first conductive strip assembly 201 and the second conductive strip assembly 100 are not in electrical communication with each other in their nature relaxed state (as shown in FIG. 1); in their function state there is electrical communication (as shown in FIG. 12).

The battery-operated product 10 may be tested by the prospective purchaser while the product 10 is still sealed within the package 1 by pressing the first conductive strip assembly 201 against the second conductive strip assembly 100 and completing an electrical circuit. A conductive tape 202 of the first conductive assembly 201 completes a circuit path (FIG. 5) with the second conductive strip assembly 100 by removing the gap 103 of the second conductive strip assembly 100 therein allowing activation of some or all of the electronic parts of the battery operated product 10 located inside the package 1. Activation of the product 10 therein occurs without opening the package 1 allowing it to be returned to shelf for sale if not purchased by the prospective consumer. The conductive tape 202 may activate components of the product 10 (while still in the packaging 1) which may emit sounds, produce light, or cause motion which may be observed by a person holding the sealed package 1. Employing multiple conductive strips 100 and tapes 202 may activate different components of the product 10 in different areas of the sealed package 1. In an embodiment, the gap 103 of the second conductive strip assembly 100 is smaller than the gap of the first conductive strip assembly 201. The smaller gap 103 of the second conductive strip assembly 100 makes the system resistant to accidentally activating a battery 104A (as described below).

In an embodiment, the second conductive strip assembly 100 is temporarily secured to the product 10 by a light adhesive and wherein the second conductive strip assembly 100 may be easily removed from the product 10 and discarded after opening of the package. In yet another embodiment, the second conductive strip assembly 100 lacks an adhesive and is temporarily secured to the product 10 simply by being partially secured by the battery cover 14 (see FIG. 1) as will be described below. Once the product 10 is removed from the packaging, the second conductive strip 100 is pulled away from the battery compartment (the area below the battery cover 14) and the second conductive strip 100 may then be discarded.

The present device provides an inexpensive way to activate a battery-operated product 10 while the product 10 remains sealed within packaging 1. The present device utilizes both conductive strip assemblies and tapes 202 to facilitate demonstration of the products 10 functions and use. The product 10, housed in a display package 1 or bag 700 (as illustrated in the FIG. 7 embodiment), may include a portion that produces sound, light, or motion by applying pressure to certain portions of the package 1. Utilizing the conductive strip assemblies and tapes 202 of the packaging 1 of the present device is an inexpensive activation method for demonstrating component parts of a product 10 without opening or deforming package 1. Further, the present device allows for keeping the product 10 in a brand new state for sale even after testing.

Figure 9:
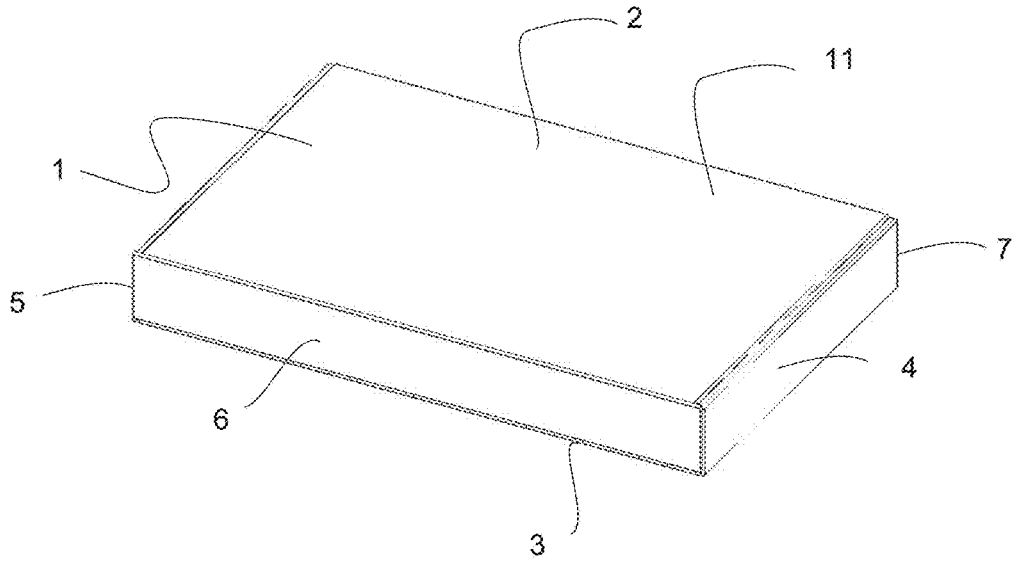
FIG. 9 illustrates a perspective view of the product package 1 wherein the lid 2 of the product package 1 is in the closed orientation.
Figure 10:
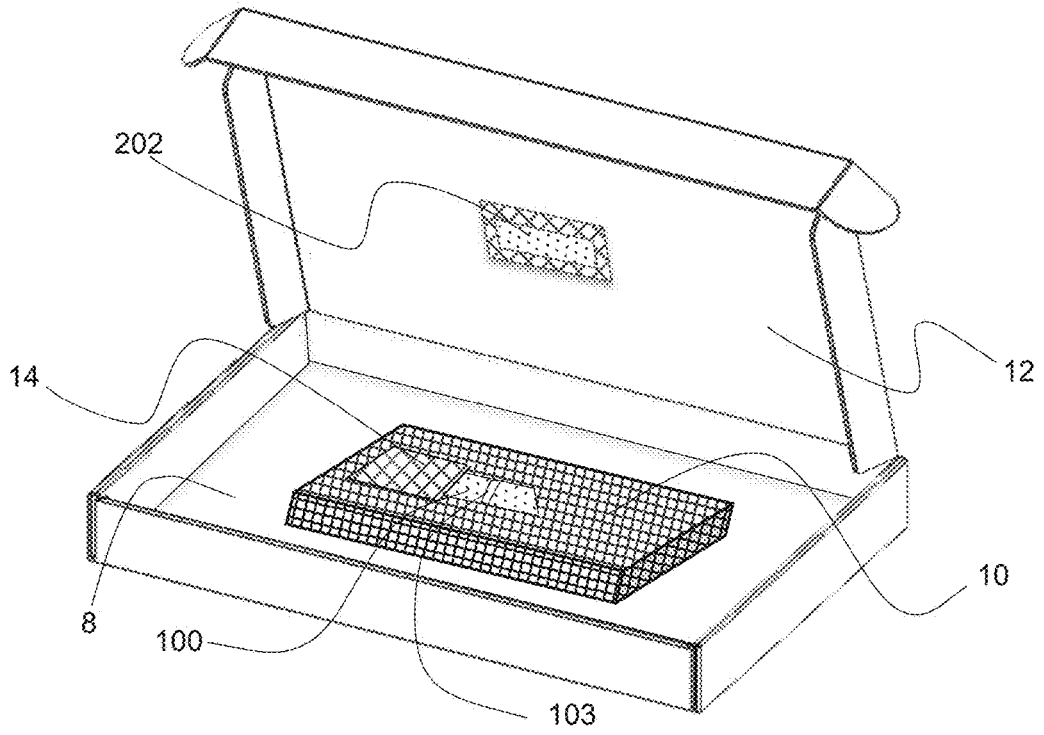
FIG. 10 illustrates a perspective view of the product package 1 wherein the lid 2 of the product package 1 is in the open orientation and wherein the product 10 is visible.

Referring now to FIGS. 9 and 10, in an embodiment, a product package 1 having electronically active components and electronically non-active components is provided. The product package 1 may have a top 2, a bottom 3, a first side 4, a second side 5, a front 6, a back 7 and a generally hollow interior 8 (FIG. 10) wherein a product 10 is located within the generally hollow interior 8. The product package 1 may be made largely from, for example, cardboard, plastic or the like and may have electronic components in addition to the non-electronic components (such as cardboard). The product 10 may be, for example, a toy construction set, truck or another electronic toy.

In an embodiment, the top 2 of the product package 1 may serve as the lid of the product package 1 wherein the top 2 has an exterior facing surface 11 and an interior facing surface 12 (FIG. 10). Located on the interior facing surface 12 of the top 2, may be a conductive tape 202. Located on the product 10 may be a conductive assembly 100 having a first end 100A and a second end 100B (see FIG. 1A). In an embodiment, the conductive assembly 100 may have three layers 114, 113, and 101. The first layer 114 and the third layer 101 may be made from a generally conductive material (such as an aluminum tape or conductive paint strip). The second layer 113 may be made from a non-conductive material such as paper or thin plastic. In an embodiment, the third layer 101 wraps around and may be connected at the second end 100B of the conductive assembly 100 so that the first layer 114 and the third layer 101 may be electrically connected to each other (as described below). The first end 100A of the conductive assembly 100 may not be covered by the electrically conductive material of the first layer 114 or the third layer 101.

Figure 2:
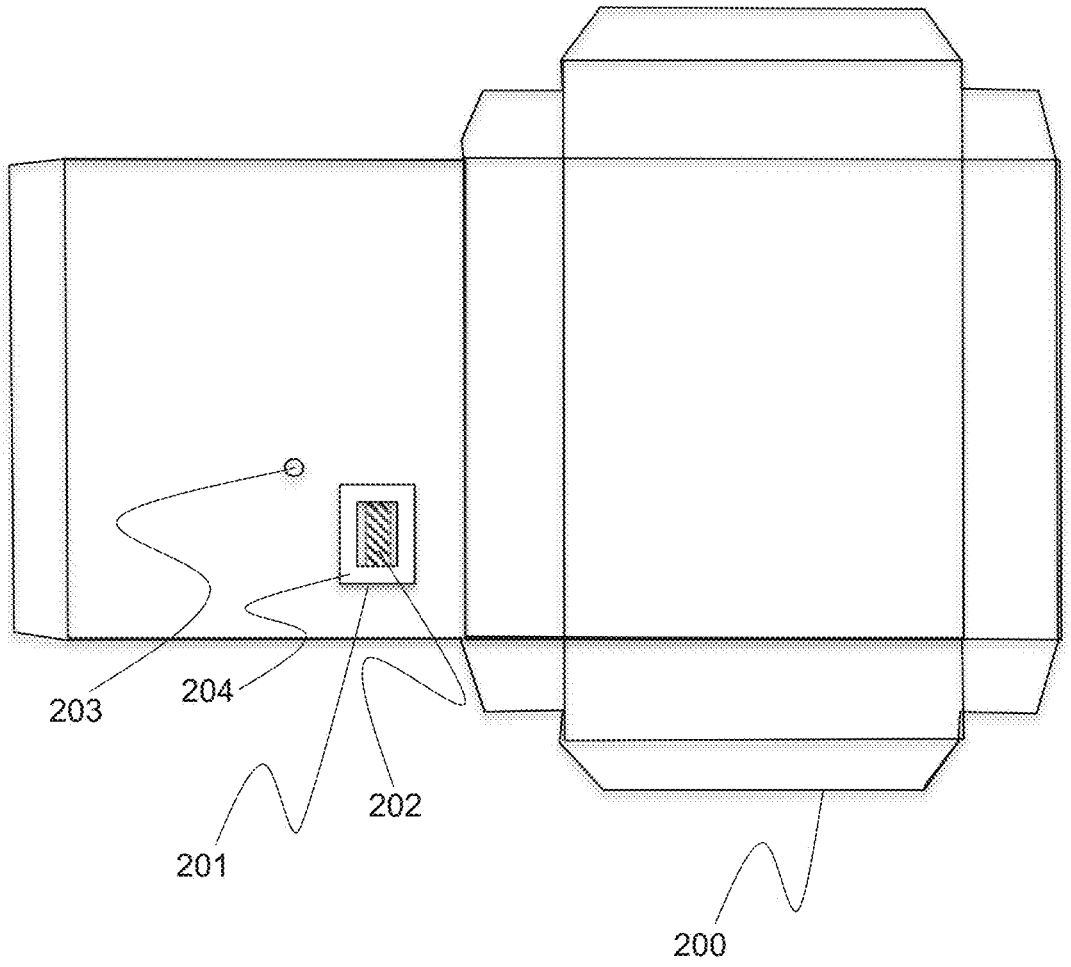
FIG. 2 illustrates a plan view of a display package in a flat orientation with a conductive area 202 on the cover that is used to activate a portion of the product inside the package.

Referring to FIGS. 1 and 2, in an embodiment, the first layer 114 may have a gap 103. In particular, the gap 103 may be a portion of the conductive assembly 100 wherein there is a break in the first layer 114 such that a portion of the second layer 113 is exposed (in addition to the first end 100A of the conductive assembly 100 which is also non-conductive). The gap 103 may therein generally electronically isolate a contact 104 of a battery 104A from a battery contact 105 (which contacts the third layer 101) of the product 10 as described below. In an embodiment, the gap 103 is generally rectangular in shape.

In an embodiment, even though the product 10 using this first conductive strip assembly 201 is switched to the power "on" state during packaging, the battery contact 104 remains broken by the gap 103 in the first layer 114 of conductive strip assembly 100 and the product 10 therein remains electrically without power. Conductive strip assembly 100 enters the product 10 through a partially open battery cover 14 of a battery compartment (area located below 14 in FIG. 1). In an embodiment, the gap 103 of conductive strip assembly 100 is external to the product 10 (but still within the packaging 1) and is affixed directly under the conductive tape 202 of the first conductive strip assembly 201 of the packaging 1. Thus, the first conductive strip assembly 201 is located in the narrow space between the product 10 and the underside 12 of the lid.

In an embodiment, the conductive tape 202 (or the "first layer") (FIG. 5) may be permanently secured to a portion of the inner facing surface 12 of the top 2 (or the "lid") of the product package 1. In particular, in an embodiment, the inner facing surface 12 of the top 2 of the product package 1 may have an insulating spacer 204 (the "second layer") which supports the conductive tape 202 and provides a space 115 (FIG. 1) to prevent shorting when packages are stacked.

The first conductive strip assembly 201 may have a first layer 202 and a second layer 204 wherein the first layer 202 of the first conductive strip assembly 201 is electrically conductive and wherein the second layer 204 (or "spacer") of the first conductive strip assembly 201 is not electrically conductive. In particular, the same conductive and non-conductive material used to make the elements of the second conductive strip assembly 100 may be used in the first conductive strip assembly 201.

Figure 4:
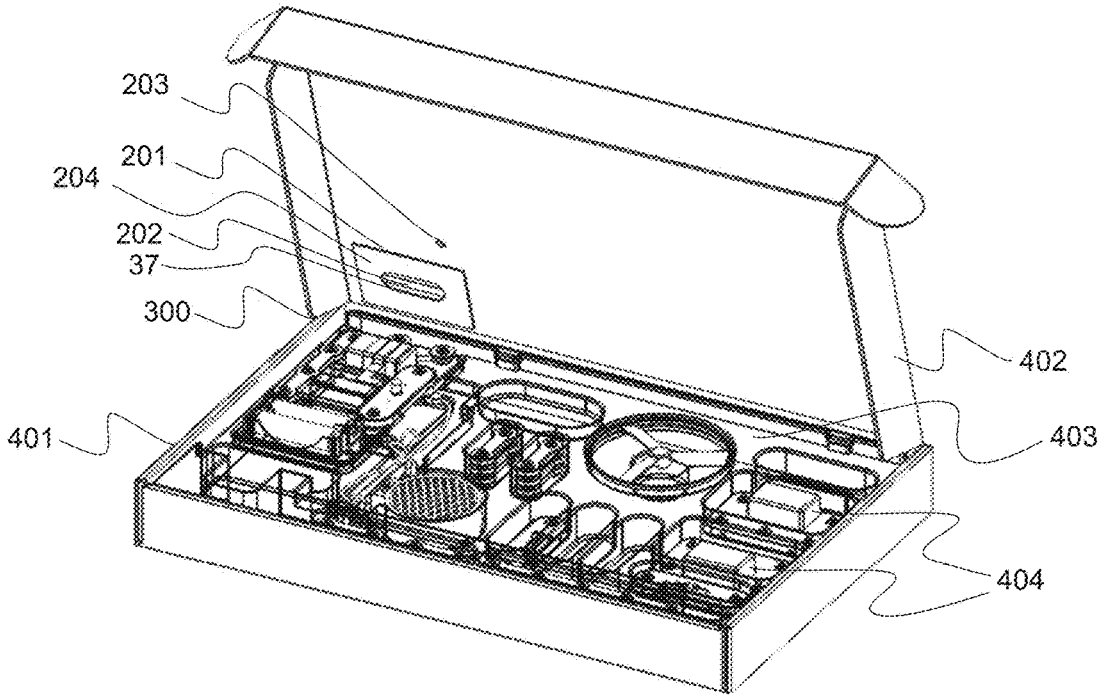
FIG. 4 illustrates an open lid 402 box view of FIG. 3 with tray 403 inside.

In an embodiment, the second layer 204 of the first conductive strip assembly 201 may have a gap 37 (FIG. 4). In an embodiment, the gap 37 is oval, as is illustrated in FIG. 4. The second layer 204 may therein act as a "spacer" between the second conductive assembly 100 and the first conductive assembly 201. The gap 37 of the second layer 204 of the first conductive assembly 201 may expose the conductive surface of the first layer 202 of the first conductive assembly 201. When pressure 111 is applied to the exterior facing surface 11 of the top 2 of the product package 1 (therein slightly and temporarily deforming a portion of the top 2, see FIG. 12), the electrically conductive layer 202 of the first conductive assembly 201 is forced downward where it contacts the first layer 114 of the second conductive assembly 100 and electrically fills the gap 103 of the first layer 114 of the second conductive assembly 100. As a result, the first layer 114 and the third layer 101 of the second conductive assembly 100 are then in electrical communication and the battery 104A may therein power the product 10 so a user may test the product 10 while the product 10 is still within the interior 8 of the product package 1. When pressure 111 is released from the top 2 of the product package 1, the conductive assembly 201 and the conductive assembly 100 no longer are in electrical communication and the product 10 is thus no longer powered by the battery 104A and the battery 104A is not wasted.

When an application of uniform pressure across the entire top 2 of the product package 1 is applied, such as when boxes are stacked, a space 115 between the first conductive assembly 201 and the second conductive assembly 100 created by the second layer 204 (or the "spacer") of the first conductive assembly 201 therein prevents a short between the third layer 101 in the second conductive assembly 100. Only a local application of pressure 111 in a specific area of the top 2 of the product package 1 may temporarily deform the top 2 of the product package 1 enough to force the first conductive assembly 201 to remove the gap 103 of the second conductive assembly 100 and restore electrical contact between the battery contact 104 and the product contact 105 (FIG. 12). When said pressure 111 is applied to the top 2 area of the package 1 there must also be an equal and opposite pressure 112 applied to the bottom 3 of the package 1 to prevent the package 1 from moving and allow the top 2 to deform.

Figure 3:
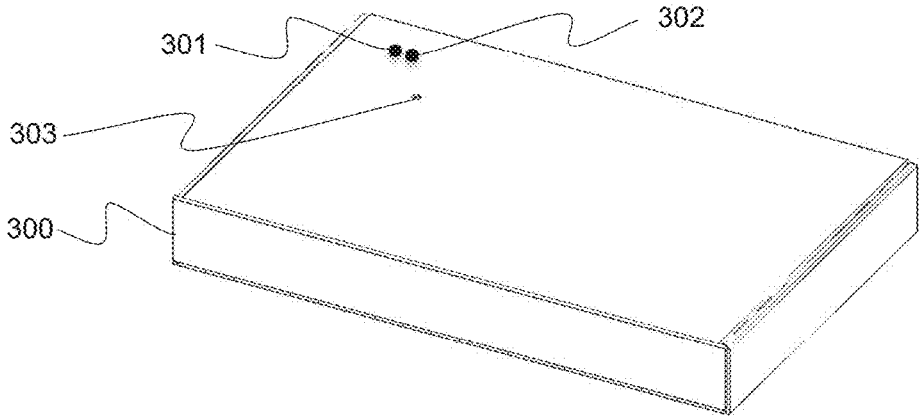
FIG. 3 illustrates a closed box view 300 of the display packaging of FIG. 2.

FIG. 2 illustrates the device in a flat box orientation 200 before the device is folded to hold the product 10. An area of the flat box 200 contains the conductive tape 202 of the first conductive strip 201 (partially covered by the insulating spacer 204 which in this figure is rectangular) which may be automatically installed on the box 200 before the box is folded for storage of the product 10. In an embodiment, an opening 203 for viewing an LED may also be present on the flat box 200. FIG. 3 illustrates the flat box 200 of FIG. 2 after it has been folded into the box orientation 300 wherein two marked areas 301, 302 (where the conductive tape 202 is located inside the box 300) is visible. The marked areas 301, 302 may be indicia informing a user where to press down so as to test the product 10 while the product 10 is still within the package. Further, in this figure, the other side of the opening 203 of FIG. 2 is illustrated as 303.

FIG. 4 illustrates an alternative embodiment of the packaging 1. In this embodiment, the packaging 1 is in the box orientation 300 and a lid 402 of box 300 is in the open position and wherein a base 401 of box 300 utilizes a tray 403. Temporarily located within the tray 403 may be parts 404 of the product 10. The lid 402 may contain the conductive tape 202, covered by an insulating spacer 204, and an opening 203 for viewing an LED or the like which may be located within the sealed package 1.

Toy sets with quick connect assembly systems are known. However, in the present device, the device utilizes a box 300 having a tray 403 which may be filled with electronic devices 404 which quickly snap to each other or to the tray 403 directly. Diagrams for hundreds of circuits may be included to educate a student or entertain a child. When these circuits are assembled the child can listen to audio affects and watch flashing lights.

Figure 5:
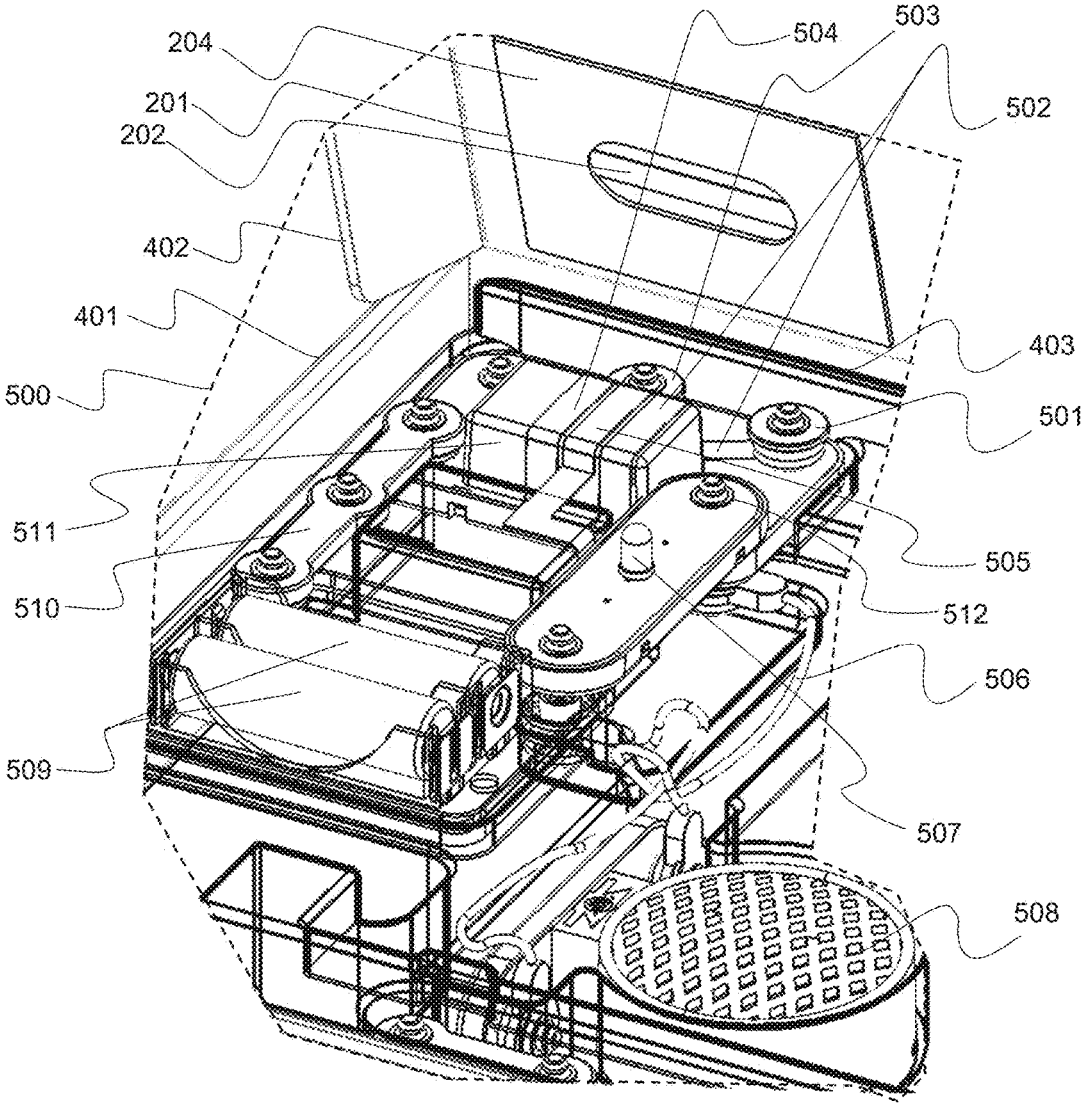
FIG. 5 illustrates a detailed view of the left portion 500 of FIG. 4.

FIG. 5 illustrates a detailed view 500 of the left side of the lid 402 and the base 401 of the device of FIG. 4. In the tray 403 may be, for example, electrical wires 506, a light emitting diode 507, an audio speaker 508, batteries 509, a connection component 510, and an audio block 511 which may be snapped together to form an unpowered sound affect circuit. To power on the sound affect circuit the battery 509 voltage must be placed on audio block 511 pin 501 or on audio block 511 pin 503.

Figure 6:
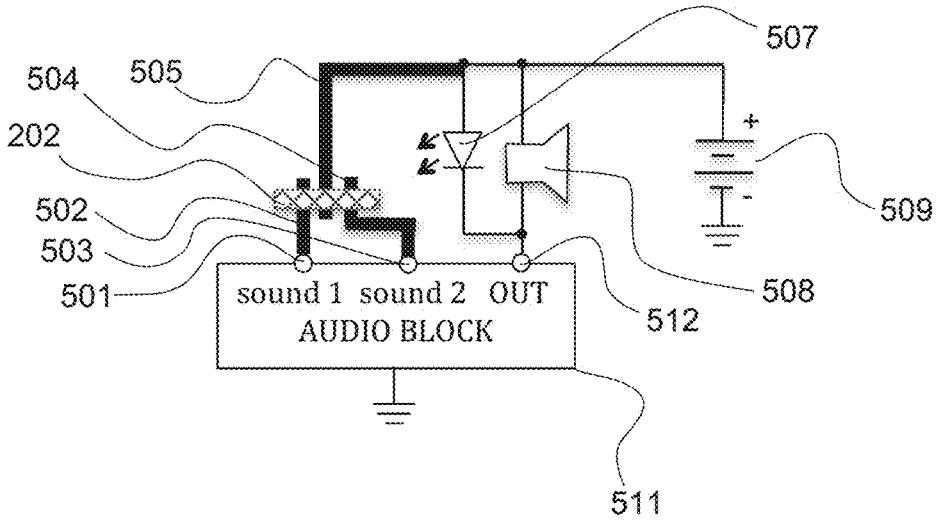
FIG. 6 illustrates an electronic schematic of the circuit shown in FIG. 5

On the top of the audio block 511 may be a piece of conductive tape 505 which may be connected to battery 509 voltage. Affixed on the top of audio block 511, and in close proximity to the battery voltage conductive tape 505, may be a conductive tape 504 connected to pin 503. Further, also affixed at the top of audio block 511, and in close proximity to the battery voltage conductive tape 505, may be another conductive tape 502 connected to pin 501. When the box lid 402 is closed the conductive tape 202 may be placed directly above and perpendicular to conductive tapes 502, 504, and 505 (as shown in FIG. 6). When area 302 in FIG. 3 is pressed downward, it will push the conductive tape 202 down and will therein short conductive tape 505 to conductive tape 502 therein activating sound 1 in the Audio Block 511. When area 301 in FIG. 3 is pressed downward, it will push conductive tape 202 down and will therein short conductive tape 505 to conductive tape 504 activating sound 2 in the Audio Block 511. Whenever the Audio Block 511 is activated, it flashes the Light Emitting Diode 507 and therein sends audio to speaker 508 producing a visual and audio affect without opening the package in accordance with an embodiment of the present invention. FIG. 6 illustrates an electronic schematic of the physical parts described in FIG. 5.

In an alternative embodiment, as illustrated in FIG. 5, the battery voltage conductive tape 505 may act similar to the second conductive strip assembly 100 of FIG. 1. In this embodiment, the battery voltage conductive tape 505 may lack multiple layers (FIG. 1 illustrates the second conductive strip assembly with three layers) and instead, may the battery voltage conductive tape 505 may utilize a single layer which is electrically conductive and which may be activated upon being contacted by the first conductive strip assembly 201 of the housing. Further, in an alternative embodiment, the battery voltage conductive tape 505 may be permanently secured to the product (FIG. 5 illustrates the battery voltage conductive tape 505 secured to the audio block 511 in an embodiment). Further, in this embodiment, the first conductive strip assembly 201 is bendable while the battery voltage conductive tape 505 remains in a flat orientation secured to a portion of the product.

Figure 1A:
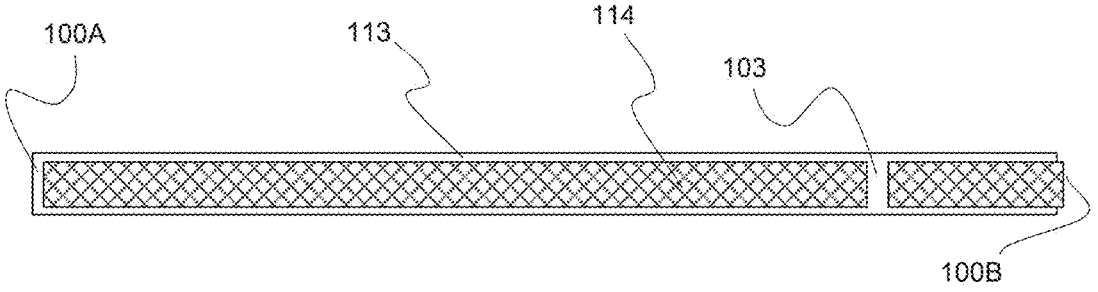
FIG. 1A illustrates a top view of conductive strip assembly 100.
Figure 7:
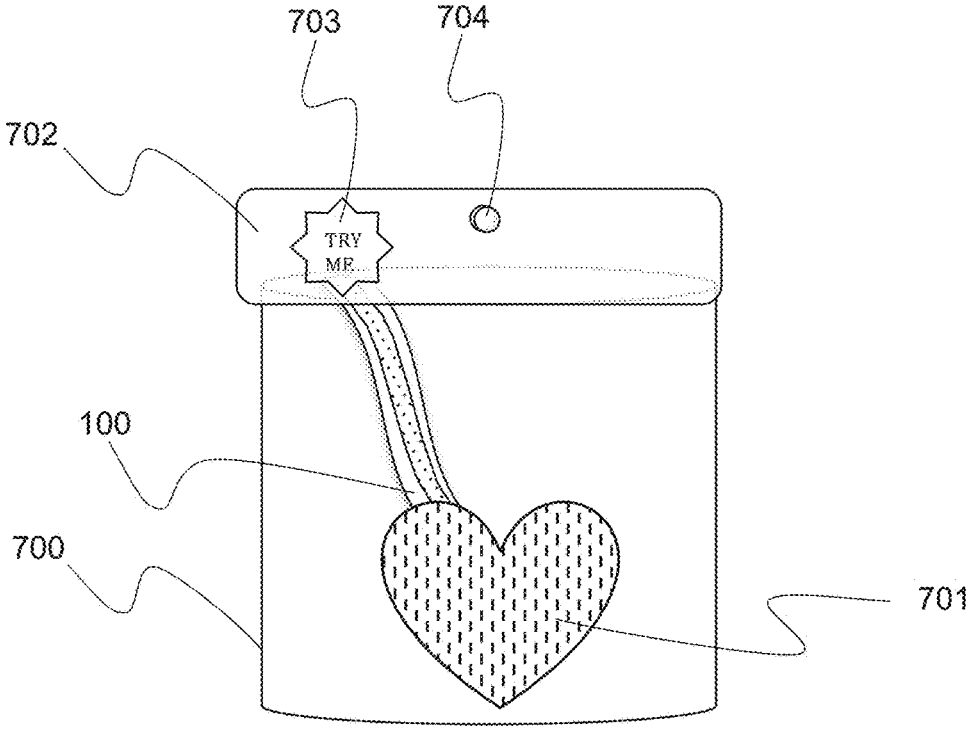
FIG. 7 illustrates a bag 700 with a cardboard header 702 using conductive strip 100 shown in FIG. 1A to activate a battery-operated device 701.
Figure 11:
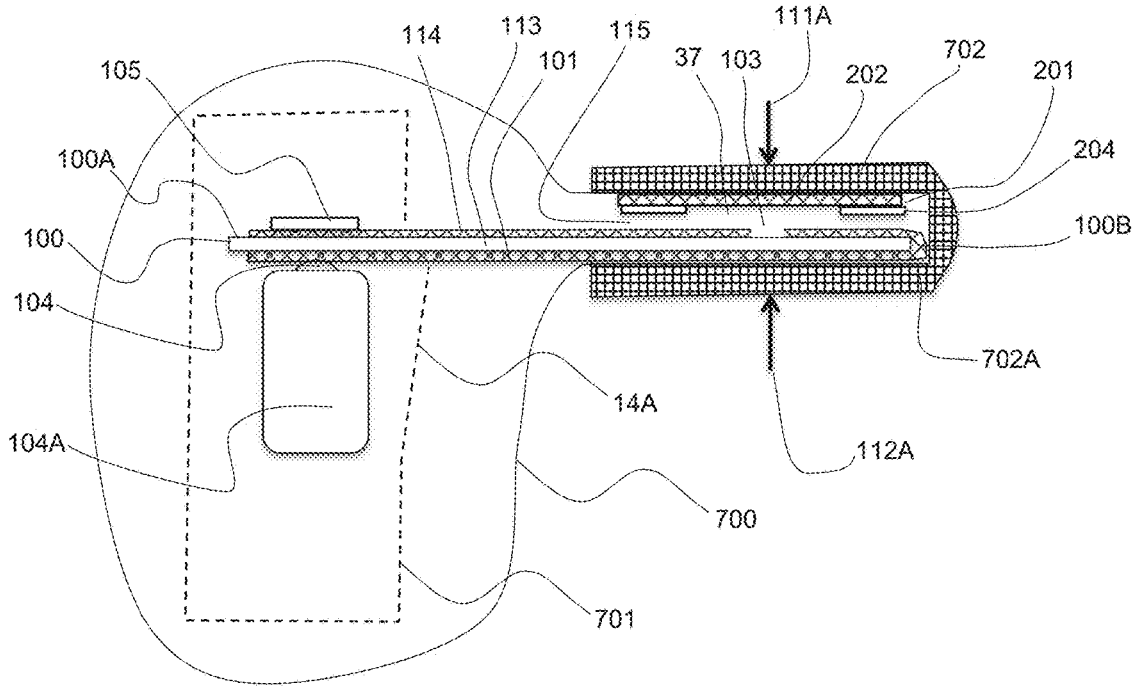
FIG. 11 illustrates a cross sectional side view of a bagged 700 product package with header 702 wherein the product 701 is visible inside the package bag 700.

Referring now to FIG. 7, in an embodiment, a bag 700 with a cardboard header 702 having a conductive strip assembly 100 (similar to as shown in FIG. 1A) to activate a battery operated device 701 is illustrated. The device 701 may be, but is not limited to, a heart shaped toy that lights up and plays music when battery is inserted and device is powered on. A cutaway view of the cardboard header 702 and device 701 of FIG. 7 is shown in FIG. 11. In this embodiment, attached to the front part of header 702 is the conductive tape 202 and insulating spacer 204. The conductive strip assembly 100 is attached to the back part of header 702A as shown in FIG. 11. The gap 103 may be placed directly under the "Try Me" area 703 and aligned to activate the battery-powered product 701 when pressure 111A, 112A is applied as shown in FIG. 11. The end of conductive strip assembly 100 that is not in the header 702 may enter the product 701 through a partially closed battery door 14A.

A hole 704 may also provided in the cardboard header 702 so as to allow the hanging of the product 10 on a hook in a store. When a customer squeezes the "Try Me" area 703, the product 701 will be activated in accordance with the embodiment of the present device. When the product 701 is removed from the bag 700 and the conductive strip assembly 100 is removed from the product 701, the product 701 will operate normally as designed.

Also being sold today are three-dimensional electromechanical systems for making mechanical structures using snap-together conductive building blocks 802, 803 that easily demonstrate the principles required in making three-dimensional electronic circuits incorporated in the mechanical structures. Included in these products are means for attaching to other electronic modules to power these three-dimensional circuits.

Figure 8:
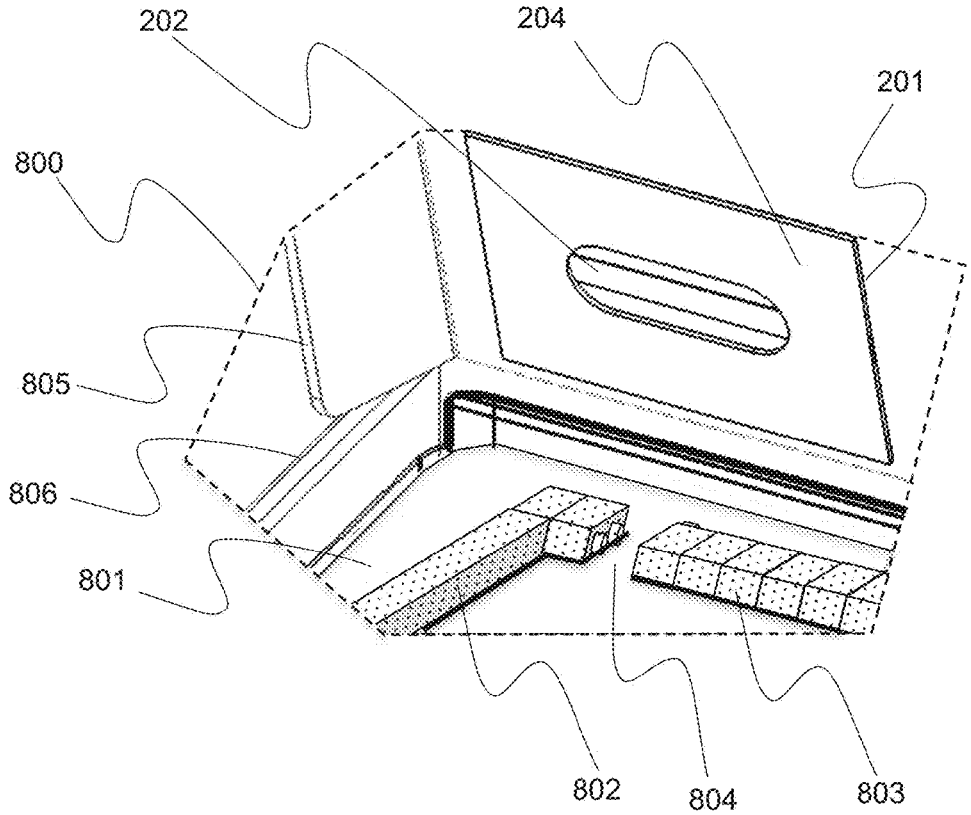
FIG. 8 illustrates a Tray 801 with break 804 between conductive construction blocks 802, 803 in box 300.

FIG. 8 illustrates an enlarged section 800 of the left side of box 300 with box lid 805 open and tray 801 in the base 806 section of the box 300. In tray 801 is shown two electrically conductive runs 802, 803 isolated from each other by a gap 804. In particular, in an embodiment, the exterior surface(s) of the product itself (illustrated as 'electrical blocks' 802 and 803) may be electrically conductive (as opposed to utilizing a distinct separate electrical strip as is illustrated in FIG. 1 with the second electrical element 100). As a result, the product itself 802, 803 may be electrically activated by contact from the conductive tape 202 when depressed. More specifically, the conductive tape 202 may span the gap 804 (which is a physical and electrical gap) and may electrically complete the circuit when the conduct tape 202 is depressed and therein contacts both sides 802 and 803 of the electrical blocks.

These electrically conductive runs 802, 803 are held in place and position in the box 300 by the tray 801. Attached to and fixed in the lid 805 of box 300 may be a conductive tape 202 with an insulating spacer 204 such that when lid 805 is closed, the conductive tape 202 will be positioned directly above the gap 804 and spaced to prevent touching conductive runs 802, 803 by insulated spacer 204. When pressure from an object similar to a finger is applied on the closed lid 805 in the area of the conductive tape assembly 201 to deform the lid, the conductive tape 202 will produce an electrical short between conductive runs 802, 803 by bridging the gap 804 and act as a switch to turn on any correctly installed electrical circuit in the box 300.

Removing the pressure from the lid 805 of the box 300 will act as the equivalent of removing power from any correctly installed electrical circuit in the box 300. In this manner a single strip of conductive tape 202 and an insulating spacer 204 acts as the equivalent of a momentary single pole electronic switch at much less cost. Also the present device is unique since removing the tray 801 from the box 300 destroys the switch function, where an installed physical momentary switch would still be operable. Note, this arrangement does not require any other conductive strips 100 and uses the product itself to produce the gap 804 that can activate a circuit using conductive strip assembly 201 only in accordance with the embodiment of the present invention.

FIG. 11 shows a cross sectional view of a product 701 inside a plastic bag 700 and header 702. In particular, FIG. 11 illustrates a conductive strip assembly 100 passing through partially open battery cover 14A to isolate battery contact 104 from battery clip 105. The gap 103 on second conductive strip assembly 100 is fixed to the backside of header 702A with first conductive assembly 201 fixed to the front of header 702 directly across from gap 103 in second conductive strip assembly 100. Only a local application of pressure 111A, 112A in a specific area across header 702 of the product package may temporarily deform the header 702 enough to force the first conductive assembly 201 to remove the gap 103 of the second conductive assembly 100 and restore electrical contact between the battery contact 104 and the product 701 contact 105 inside the hanging bag package.

Although embodiments of the invention are shown and described therein, it should be understood that various changes and modifications to the presently preferred embodiments would be apparent to those skilled in the art. Such changes and modifications may be made without departing from the spirit and scope of the invention and without diminishing its attendant advantages.

I claim:

1. A product package system comprising:

a housing forming a packaging wherein the housing has a top, a bottom, a front, a back, a first side, a second side and a generally hollow interior;

a product having electrical circuitry located within the generally hollow interior of the housing;

a first electronic component connected to the housing wherein the first electronic component has a first layer and a second layer wherein the first layer is electronically conductive and wherein the second layer is not electronically conductive and wherein the second layer is located on the first layer and wherein the second layer has a gap exposing the electrically conductive first layer of the first electronic component;

a second electronic component located on the product wherein the second electronic component is electrically connected to the electrical circuitry of the product and wherein the second electronic component has a first layer, a second layer and a third layer and wherein the first layer and the third layer are electronically conductive and wherein the second layer is not electronically conductive;

wherein the first layer or the third layer of the second electronic component is electronically connected to a battery which is connected to the product; and a gap in the first layer or the third layer of the second electronic component.

2. The product package system of claim 1 wherein the battery of the product is stored in the on position in the housing.

3. The product package system of claim 1 further comprising:

an opening on the housing wherein the opening exposes an LED located on the product.

4. The product package system of claim 1 wherein the gap of the first electronic component is located proximate to the gap of the second electronic component and wherein depressing the top of the housing forces the first electronic component to make an electrical contact with the second electronic component of the product and therein activates the product.

5. The product package system of claim 1 wherein the second electronic component is partially located between the product and the battery and further wherein the second electronic component contacts both the product and the battery.

6. The product package system of claim 1 wherein the first electronic component of the housing is permanently connected to an underside of the top of the housing and wherein the top of the housing forms a lid of the housing.

7. The product package system of claim 1 further comprising:

a battery compartment located within an interior of the product wherein the battery compartment has a battery cover lid and wherein the first electronic component partially is stored within the battery compartment and extends outside of the battery compartment.

8. The product package system of claim 1 wherein the battery electrically powers an audio producing component of the product.

9. The product package system of claim 1 wherein the second electronic component is capable of being removed from the product after opening of the housing forming the product package.

10. The product package system of claim 1 wherein the first electronic component is bendable.

11. The product package system of claim 1 wherein the second electronic component is bendable.

12. The product package system of claim 1 further comprising:

an area of indicia located on the top of the housing wherein the area of indicia is capable of informing a user where to press down on the housing to test the product located within the interior of the housing.

13. The product package system of claim 1 wherein the first electronic component and the second electronic component are not in electrical communication with each other in their respective relaxed state.

14. A product package system comprising:

a housing forming a packaging wherein the housing has a top, a bottom, a front, a back, a first side, a second side and a generally hollow interior;

a product having electrical circuitry located within the generally hollow interior of the housing;

a first electronic component connected to the housing wherein the first electronic component has a first layer and a second layer wherein the first layer is electronically conductive and wherein the second layer is not electronically conductive and wherein the second layer is located on the first layer and wherein the second layer has a gap exposing the electrically conductive first layer of the first electronic component;

a second electronic component located on the product wherein the second electronic component is electrically connected to the electrical circuitry of the product and wherein the second electronic component has a single conductive layer and lacks a non-conductive layer;

wherein the conductive layer of the second electronic component is electronically connected to a battery which is connected to the product; and wherein the gap of the first electronic component is located adjacent to the second electronic component of the product.

15. The product package system of claim 14 wherein the first electronic component is bendable.

16. The product package system of claim 14 wherein the gap of the first electronic component is an oval opening in the second layer.

17. The product package system of claim 14 wherein the conductive layer of the second electronic component is permanently secured to the product.

18. The product package system of claim 14 wherein depressing the first electronic component of the housing into the second electronic component of the product completes an electrical connection between the first electronic component and the second electronic component.

19. The product packaging system of claim 14 wherein the second layer of the first electronic component is capable of preventing the electrical communication between the first layer of the first electronic component and the second electrical component.

20. A product packaging system comprising:

a housing forming a packaging wherein the housing has a top, a bottom, a front, a back, a first side, a second side and a generally hollow interior;

a product having electrical circuitry located within the generally hollow interior of the housing;

a first electronic component connected to the housing wherein the first electronic component has a first layer and a second layer wherein the first layer is electronically conductive and wherein the second layer is not electronically conductive and wherein the second layer is located on the first layer and wherein the second layer has a gap exposing the electrically conductive first layer of the first electronic component;

wherein the product has an exterior surface which is electrically conductive;

an electrical and physical gap in the product which prevents electrical activation of the product; and wherein the first electronic component is flexible and is capable of being depressed to contact the product and remove the electrical gap.

* * * * *